US010407993B2

(12) United States Patent
Dirksen et al.

(10) Patent No.: US 10,407,993 B2
(45) Date of Patent: Sep. 10, 2019

(54) HIGH-VOLTAGE DRILLING METHODS AND SYSTEMS USING HYBRID DRILLSTRING CONVEYANCE

(71) Applicant: Halliburton Energy Services, Inc., Houston, TX (US)

(72) Inventors: Ron Dirksen, Spring, TX (US); Blaine C. Comeaux, Spring, TX (US); Christopher A. Golla, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/893,391

(22) Filed: Feb. 9, 2018

(65) Prior Publication Data

US 2018/0163478 A1 Jun. 14, 2018

Related U.S. Application Data

(63) Continuation of application No. 14/784,922, filed as application No. PCT/US2013/041944 on May 21, 2013, now abandoned.

(51) Int. Cl.

| | |
|---|---|
| ***E21B 17/00*** | (2006.01) |
| ***E21B 17/20*** | (2006.01) |
| ***E21B 19/22*** | (2006.01) |
| ***E21B 7/15*** | (2006.01) |

(52) U.S. Cl.

CPC ..... *E21B 7/15* (2013.01); *E21B 17/00* (2013.01); *E21B 17/003* (2013.01); *E21B 17/206* (2013.01); *E21B 19/22* (2013.01)

(58) Field of Classification Search

CPC ..... E21B 7/15; E21B 17/003; E21B 17/206

See application file for complete search history.

(56) References Cited

U.S. PATENT DOCUMENTS

| | | |
|---|---|---|
| 4,534,424 A | 8/1985 | Ramsey |
| 6,446,737 B1 | 9/2002 | Fontana et al. |

(Continued)

FOREIGN PATENT DOCUMENTS

| | | |
|---|---|---|
| WO | 2014189491 A1 | 11/2014 |

OTHER PUBLICATIONS

Mcneil, F., et al., "Innovative Method of Gas Shale Well Intervention With Coiled Tubing/Jointed Tubing Hybrid String," SPE 146413, Society of Petroleum Engineers, SPE Annual Technical Conference and Exhibition, Oct. 30, 2011, 14 pages.

(Continued)

*Primary Examiner* — David J Bagnell
*Assistant Examiner* — Brandon M Duck
(74) *Attorney, Agent, or Firm* — Alan Bryson; Parker Justiss, P.C.

(57) ABSTRACT

In at least some embodiments, a high-voltage drilling system includes a a power supply to output high-voltage power to an electrical conductor, a bit that extends a borehole based on the high-voltage power, and a hybrid drillstring that transports a fluid flow from the bit to convey detached formation material out of the borehole. At least part of the electrical conductor resides within the hybrid drillstring to convey power to the bit. The hybrid drillstring includes a coiled tubing section and a jointed pipe section.

17 Claims, 4 Drawing Sheets

(56) References Cited

U.S. PATENT DOCUMENTS

| | | | | |
|---|---|---|---|---|
| 7,152,700 | B2 * | 12/2006 | Church | E21B 7/068 175/320 |
| 7,270,195 | B2 | 9/2007 | MacGregor et al. | |
| 8,109,345 | B2 | 2/2012 | Jeffryes | |
| 8,186,454 | B2 | 5/2012 | Moeny | |
| 2009/0014175 | A1 | 1/2009 | Peter | |
| 2009/0133929 | A1 | 5/2009 | Rodland | |
| 2010/0044102 | A1 | 2/2010 | Rinzler et al. | |
| 2010/0044106 | A1 | 2/2010 | Zediker et al. | |
| 2010/0108379 | A1 | 5/2010 | Edbury et al. | |
| 2010/0212962 | A1 | 8/2010 | Rosten et al. | |
| 2011/0048692 | A1 | 3/2011 | Ross et al. | |
| 2011/0209881 | A1 | 9/2011 | Hriscu et al. | |
| 2012/0080235 | A1 | 4/2012 | Sheppard et al. | |
| 2012/0261194 | A1 | 10/2012 | Blange | |
| 2013/0087389 | A1 * | 4/2013 | Hole | E21B 17/18 175/65 |
| 2013/0112482 | A1 * | 5/2013 | Armistead | E21B 21/08 175/57 |
| 2016/0060961 | A1 | 3/2016 | Dirksen et al. | |

OTHER PUBLICATIONS

Powerreach Service, H08265, Well Intervention, Boots & Coots, Feb. 2012, 2 pages.

* cited by examiner

FIG. 4
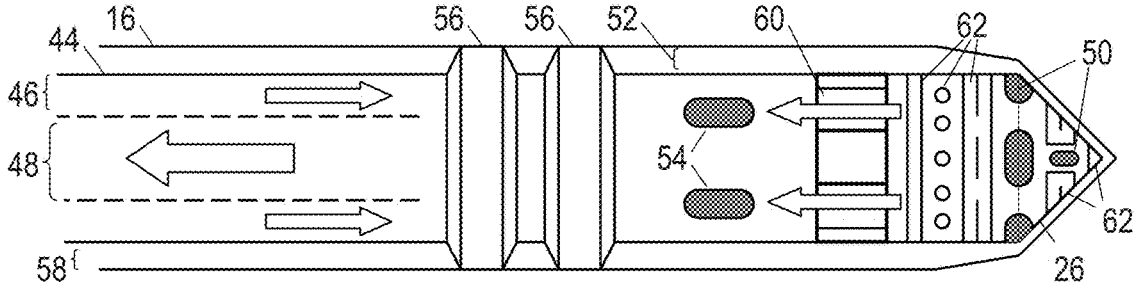
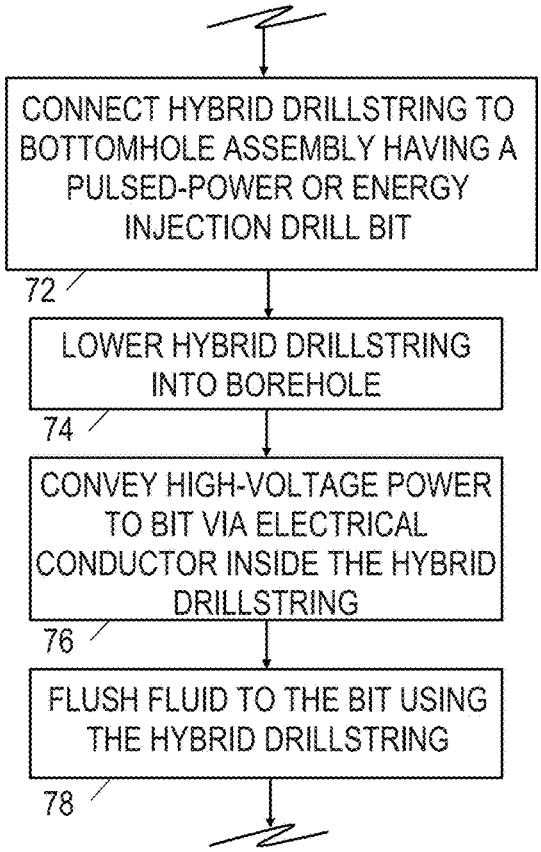
FIG. 5

HIGH-VOLTAGE DRILLING METHODS AND SYSTEMS USING HYBRID DRILLSTRING CONVEYANCE

CROSS-REFERENCE TO RELATED APPLICATIONS

This application is a continuation of U.S. patent application Ser. No. 14/784,922, entitled "HIGH-VOLTAGE DRILLING METHODS AND SYSTEMS USING HYBRID DRILLSTRING CONVEYANCE," filed on Oct. 15, 2015, which application is a 371 of International Application No. PCT/US13/41944, entitled "HIGH VOLTAGE DRILLING METHODS AND SYSTEMS USING HYBRID DRILLSTRING CONVEYANCE, filed on May 21, 2013 both applications are commonly assigned with the present invention and are incorporated herein by reference as if reproduced herein in their entirety.

BACKGROUND

There are significant dry gas reserves in tight, hard rock formations throughout the world. Economically feasible recovery of these reserves is difficult due to the low rate of penetration through these formations with traditional drilling methods. One method being explored to address this issue is the use of plasma channel drilling. However this method requires that a long electrical cable is run between the surface and the downhole tools. Running wiring in traditional jointed pipe can be a costly and time consuming affair, with an added reliability risk due to the high number of connectors required.

Coiled tubing (CT) is an efficient means to deploy cable and tools and perform well construction operations, such as drilling and stimulation. However, its utility is limited in deep and/or extended-reach wells. For example, the greater tubing lengths associated with such wells may require the use of smaller-diameter CT because reel capacity is limited. Use of smaller-diameter CT limits the pump rate that can be achieved and increases the likelihood of helical lockup.

Compared to CT, jointed pipe is a more effective and costly means to deploy tools and perform pumping operations at great depths. Jointed pipe employs sections of steel pipe added one by one to a work string. Due to the greater strength and weight of the jointed pipe sections (compared to CT), jointed pipe can extend further than CT before lockup occurs.

BRIEF DESCRIPTION OF THE DRAWINGS

There are disclosed herein in the drawings and detailed description, various high-voltage drilling methods and systems using hybrid drillstring conveyance to efficiently provide power to downhole plasma drilling tools or energy injection tools while also offering an increased drilling reach. In the drawings:

FIG. 4 shows an alternative bottomhole assembly configuration for pulsed power drilling.

FIG. 5 is a flowchart of an illustrative high-voltage drilling method.

Figure 1:
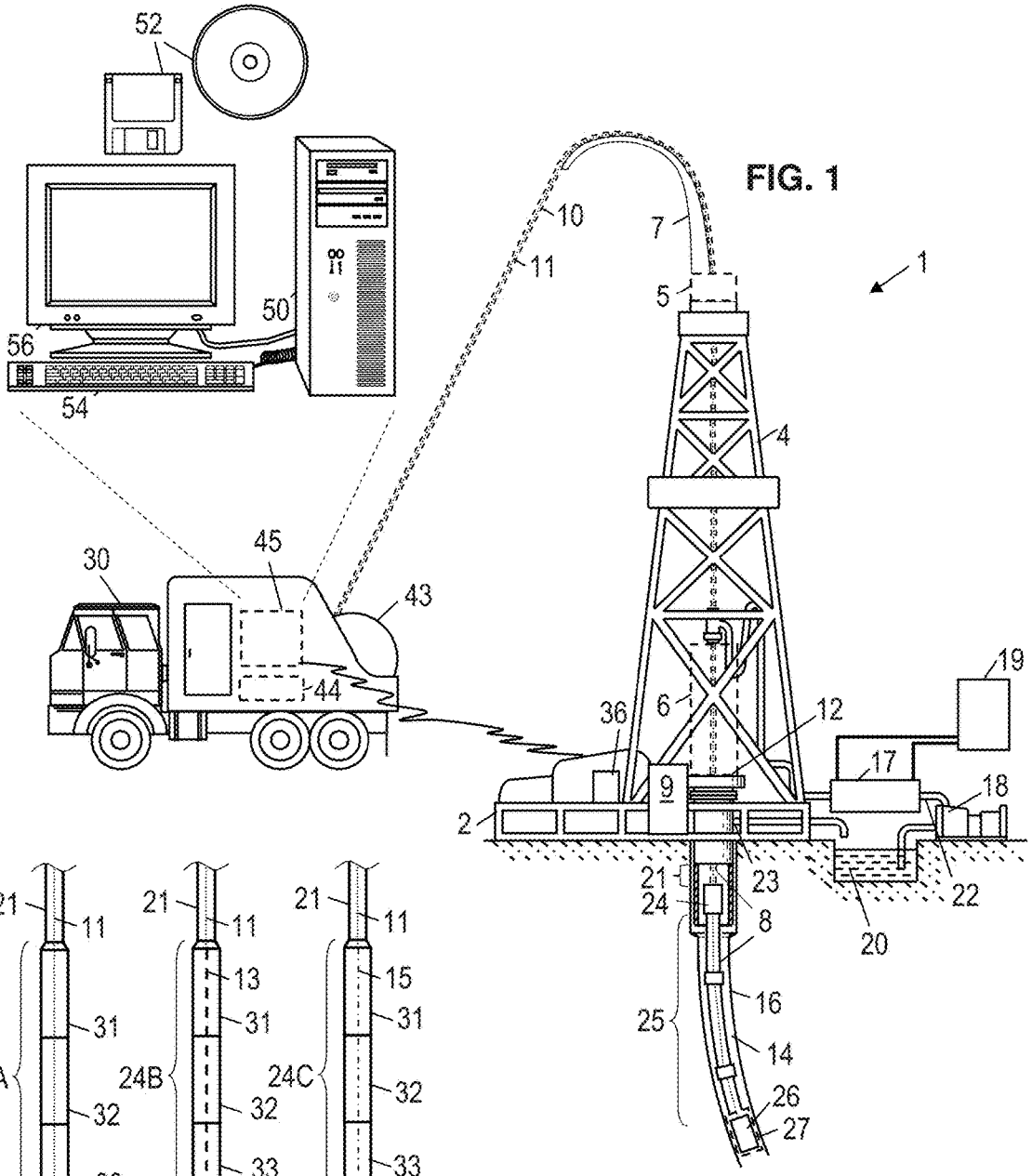
FIG. 1 shows an illustrative high-voltage drilling system.

It should be understood, however, that the specific embodiments given in the drawings and detailed description do not limit the disclosure. On the contrary, they provide the foundation for one of ordinary skill to discern the alternative forms, equivalents, and modifications that are encompassed in the scope of the appended claims.

DETAILED DESCRIPTION

High-voltage drilling methods and systems with hybrid drillstring conveyance can be designed to increase the reach, optimize the cost, and improve the safety of high-voltage drilling techniques such as pulsed-power drilling or energy injection drilling. One illustrative high-voltage drilling system includes a bit that extends a borehole by applying pulses of electric current to detach formation material. This drilling technique is referred to herein as pulsed-power drilling. Another illustrative high-voltage drilling system includes a bit that supplements a rotating drill bit with energy injection elements (e.g., lasers, heating elements, or pressure elements) to help destabilize and/or fracture the surrounding material. This drilling technique is referred to herein as energy injection drilling. For both pulsed-power drilling and energy injection drilling, the system employs a hybrid drillstring having jointed pipe at the bottom and coiled tubing at the top. The hybrid drillstring transports a fluid flow to and from the bit to convey detached formation material out of the borehole. As disclosed herein, at least some electrical conductors for the high-voltage drilling system reside within the hybrid drillstring and convey power to the bottomhole assembly or bit. In particular, high-voltage electrical conductors may reside inside the coiled tubing section to avoid exposing platform operators to high-voltage shocks. The manner in which electrical conductors are conveyed through the hybrid drillstring and/or connect to the bottomhole assembly may vary as described herein.

FIG. 1 shows an illustrative high-voltage drilling system 1 having a drilling platform or rig 2 to support a derrick 4 with an assist jack 6 for raising and lowering a hybrid drillstring 8. In some embodiments, the derrick 4 also includes a tubing straightener 5 and a tubing guide 7. The hybrid drillstring 8 includes a coiled tubing section with an end portion 21 joined to a jointed pipe section 25 by a connection interface 24. The hybrid drillstring 8 also includes an extendable portion 10 of the coiled tubing section that extends from reel 43 to end portion 21. More specifically, the extendable portion 10 wraps around reel 43 and is extended and retracted as needed. For example, during drilling operations, the extendable portion 10 increases to extend hybrid drill string 8 further into borehole 16. The maximum extension of the extendable portion 10 is determined by the capacity of the reel 43 and the diameter of the coiled tubing section. When drilling operations are finished or when drillstring extension operations are needed, the extendable portion 10 is retracted and is re-wrapped around reel 43 as the hybrid drillstring 8 is raised.

It should be noted that, during hybrid drillstring assembly or extension operations, end portion 21 of the coiled tubing section and part of jointed pipe section 25 may be raised above ground level to facilitate the assembly or extension process. Once electrical and mechanical connections are finalized, the hybrid drillstring 8 is lowered to extend borehole 16. When the maximum range of the hybrid drillstring 8 is reached, hybrid drillstring extension operations may be performed as described herein. Accordingly, the length of the jointed pipe section 25 may be extended over time, where the process of extending the hybrid drillstring 8 involves various steps such as raising the hybrid drill string 8, disconnecting the jointed pipe section 25 from the connection interface 24 and/or the end portion 21 of the coiled tubing section, adding additional jointed pipe, reconnecting mechanical and electrical connections, etc.

In some embodiments, a drill bit 26 at the lower end of the jointed pipe section 25 is powered via an electrical conductor 11 to extend borehole 16. The drill bit 26 is part of a bottomhole assembly 27 that facilitates pulsed-power drilling or heat injection drilling by providing power connectivity and fluid circulation to the drill bit 26. In pulsed-power drilling embodiments, bottomhole assembly 27 does not need to include drill collars since the drill bit 26 uses pulsed-power to extend borehole 16. Meanwhile, in energy injection drilling, bottomhole assembly 27 may include a drill collar and rotating drill bit, where the energy injection operations facilitate removal of material by a rotating drill bit. In some embodiments, the electrical conductor 11 that conveys power to the drill bit 26 extends from a power supply 44 of a surface drilling facility 30 to bottomhole assembly 27 and drill bit 26 via the extendable portion 10 of the coiled tubing section, the end portion 21 of the coiled tubing section, the connection interface 24, and the jointed pipe section 25. The electrical conductor 11 may correspond to a single conductor/umbilical extending from the power supply 44 to the bottomhole assembly 27 or to multiple conductors/umbilicals that are connected together during assembly of the hybrid drillstring 8.

For example, a conductor/umbilical may be extended through part or all of the hybrid drill string 8 using pump down operations. Additionally or alternatively, one or more reels of electrical wire may be employed to extend and retract conductors/umbilicals as needed through part or all of the hybrid drill string 8. These example conductor conveyance mechanisms or others may be implemented by a conductor management unit (or units) 9 on or near platform 2.

In accordance with embodiments, the voltage output from the power supply 44 to the conductor 11 may range from about 1 k to 30 k or more volts. As an example, lower levels of the voltage range (e.g., 1 k to 5 k volts) may be suitable for energy injection drilling operations, while higher levels of the voltage (e.g., 20 k to 30 k or more volts) may be suitable for pulsed-power drilling operations. In either case, power converters may be employed at or near bottomhole assembly 27 to convert high-voltage, low-current power conveyed by electrical conductor 11 to a lower-voltage, higher-current power for use by the drill bit 26. In some embodiments, the bit 26 uses approximately 15 amps of current and 1 megawatt of power to perform drilling operations. Other bits may have different ratings for voltage, current, and power.

As shown, the high-voltage drilling system 1 also includes recirculation equipment 18 to pump drilling fluid from a retention pit 20 through a feed pipe 22 into the annular space 14 around the hybrid drillstring 8 where it flows downhole to the drill bit 26, through ports in the bit into the hybrid drillstring 8, and back to the surface through a blowout preventer and along a return pipe 23 into the pit 20. To support fluid circulation, the connection interface 24 enables fluid flow continuity between end portion 21 of the coiled tubing section and the jointed pipe section 25. With the disclosed techniques, deeper wells are possible (compared to using coiled tubing alone or jointed piping alone), fluid circulation can be maximized (i.e., the largest diameter coiled tubing may be used), and the extendable portion 10 of the coiled tubing section may function as a protective layer for at least some portion of the high voltage electrical conductor 11 that conveys power to the drill bit 26. As an example, the extendable portion 10 of the coiled tubing section may initially extend at least between the power supply 44 and a concealed area (e.g., beneath) of the drilling platform 2 to prevent accidental or intentional damage to the high-voltage electrical conductor 11. In accordance with some embodiments, the inner diameter of the coiled tubing section is at least twice the diameter of the combined electrical conductors.

In alternative embodiments of the high-voltage drilling system 1, a crossover sub (not shown) is positioned near the drill bit 26 to direct the fluid flowing downhole through the annulus into an internal flow passage of the drill bit 26, from which it exits through ports and flows up the annulus to the crossover sub where it is directed to the internal flow passage of the hybrid drillstring 8 to travel to the surface. Further, forward circulation may be employed rather than reverse circulation to pump the drilling fluid through an internal path in the hybrid drillstring 8 to the drill bit 26, where it exits through ports and returns to the surface via an annular space 14 around the hybrid drillstring 8.

The drilling fluid transports cuttings from the borehole into the pit 20 and aids in maintaining the borehole integrity. An electronics interface 36 provides communication between a surface control and monitoring system 45 and the electronics for drill bit 26. A user can interact with the control and monitoring system 45 via a user interface having an input device 54 and an output device 56. Software on computer readable storage media 52 configures the operation of the control and monitoring system 45.

In some embodiments, the feed pipe 22 is equipped with a heat exchanger 17 to remove heat from the drilling fluid, thereby cooling it before it enters the well. A refrigeration unit 19 may be coupled to the heat exchanger 17 to facilitate the heat transfer. As an alternative to the two-stage refrigeration system shown here, the feed pipe 22 may be equipped with air-cooled radiator fins or some other mechanism for transferring heat to the surrounding air. It is expected, however, that a vaporization system would be preferred for its ability to provide greater thermal transfer rates even when the ambient air temperature is elevated.

In at least some embodiments, the drill bit 26 employs a cluster of power and return electrodes and a conduit for the drilling fluid. The drilling fluid cools the drill bit 26, transports "drill cuttings" and gas bubbles away from the face of the drill bit 26 (in case of the "cuttings") up and out of the wellbore to retention pit 20. Power to the drill bit 26 is provided by power supply 44, which may include power generator, power conditioner, and delivery system components to output high-voltage power that is subsequently provided to the drill bit 26 directly or indirectly (i.e., the high-voltage power may be further conditioned/converted downhole for use by the drill bit 26).

The drilling fluid is non-conductive to prevent electrical arcs from short-circuiting through the fluid without penetrating into the formation. If the drilling fluid mixes with conductive material (e.g., water inflow from the formation, or pulverized formation debris that is relatively conductive), the firing pulses will flash (short-circuit) between the high voltage and ground electrodes and not destroy rock. It is therefore desired to prevent, or at least control, such mixing as the drilling fluid circulates in and out of the borehole, and that all such contaminants be removed at the surface.

For example, during the rock destruction process "drill cuttings" and gas bubbles are generated, both of which should be rapidly carried away from the face of the electrode containing rock destruction device in order for the device to operate at maximum efficiency. Particularly the gas bubbles will impede system efficiency if not moved away quickly. The drilling fluid provides this flushing.

Alternatively, or in conjunction with the use of a pulsed fluid flow, the system may be designed to inhibit or minimize bubble formation through the use of fluid flow cooling and/or reverse circulation. Providing a cooled drilling fluid to the system will 1) improve the efficiency of cooling the power conditioning electronics, which in turn will improve the performance and longevity of the system, and 2) reduce the size of the gas bubbles and expedite the cooling of those gas bubbles such that they will collapse and disappear quickly and not become a problem related to maintaining fluid ECD (effective circulating density) and impeding the drilling process.

In some embodiments, reverse circulation is employed. In such case, the fluid flowing to the surface moves through a passage having a smaller cross-section than the annulus. Thus, drilling fluid moving at a given mass or volume flow rate travels with a much higher velocity through the interior passage than through the annulus. Since the efficiency with which fluid clears away debris and bubbles is related to the fluid velocity, reverse circulation systems function with relatively lower mass or volume flow rates than do systems employing normal circulation. Thus, drilling fluid cooling systems for a reverse circulation system can be designed for a lower mass flow rate, which should make it inexpensive. In other words, by using reverse circulation of the drilling fluid the rate of fluid circulation can be reduced which: 1) reduces the size and capacity of the pumps needed for circulation, 2) reduces the volume of fluid to be cooled and treated (water and solids removal)—reducing the size and capacity needs for such systems as well as achieving higher efficiency of the processes, and 3) improves hole cleaning—drill cuttings are much less likely to stay in the borehole. Moreover, the convergence from a flow path with a larger cross-section to a flow path with a smaller cross-section occurs at the bit, offering an opportunity for a flow pattern design that suppresses bubbles. A variation of the reverse circulation system design employs a dual-passage drillstring such as that manufactured and sold by Reelwell. Such drillstrings provide flow passages for both downhole and return fluid flow, thereby gaining the benefits of reverse circulation systems.

Figures 2A, 2B, 2C:
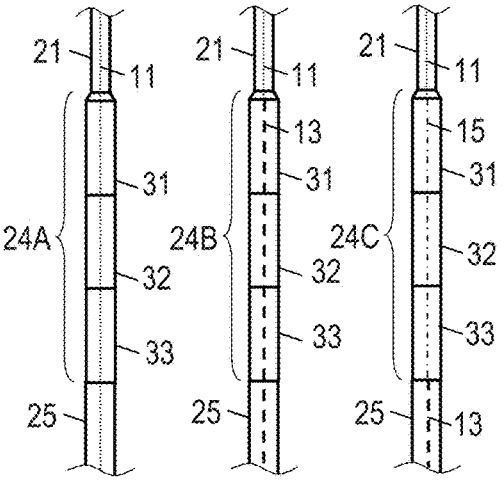
FIG. 2A-2C show illustrative connection interfaces between coiled tubing and jointed pipe.

FIG. 2A-2C show illustrative connection interfaces 24A-24C between coiled tubing and jointed pipe. When assembly of hybrid drillstring 8 is complete, connection interfaces 24A-24C join end portion 21 of the coiled tubing section with jointed pipe section 25. As shown, the connection interfaces 24A-24C includes sections 31, 32, and 33. In some embodiments, section 31 is a double slip connection, section 32 is a splined quick connection, and section 33 is a safety valve. In FIG. 2A, a single electrical connector 11 extends through the end portion 21 of the coiled tubing section, the connection interface 24A, and the jointed pipe section 25.

In FIG. 2B, electrical conductor 11 terminates at or near the connection interface 24B, and another electrical conductor 13 extends through the remaining portion of the connection interface 24B and through jointed pipe section 25. In different embodiments, the location of the connection between electrical conductors 11 and 13 may vary. For example, the connection between electrical conductors 11 and 13 may be located within any of sections 31, 32, or 33. Alternatively, the connection between electrical conductor 11 and electrical conductor 13 may be located at any of ends for sections 31, 32, or 33. In some embodiments, at least one of the sections 31, 32, and 33, includes an electrical interface or plug interface to facilitate connecting electrical conductors 11 and 13.

In FIG. 2C, electrical conductor 11 terminates at or near the connection interface 24C, and another electrical conductor 13 extends through part of connection interface 24C. Electrical conductor 13 also terminates at or near the jointed pipe section 25, and connects to electrical conductor 15, which extends through the jointed pipe section 25. In different embodiments, the location of the connection between electrical conductor 11 and electrical conductor 13 may vary. For example, the connection between electrical conductor 11 and electrical conductor 13 may be located within any of sections 31, 32, or 33. Alternatively, the connection between electrical conductor 11 and electrical conductor 13 may be located at any of ends for sections 31, 32, or 33. Similarly, the connection between electrical conductor 13 and electrical conductor 15 may be located within any of sections 31, 32, or 33. Alternatively, the connection between electrical conductor 13 and electrical conductor 15 may be located at any of ends for sections 31, 32, or 33. In some embodiments, sections 31, 32, and 33, include electrical interfaces or plug interface to facilitate connecting electrical conductors 11 and 13, and also electrical conductors 13 and 15.

Thus, in different embodiments, a double slip connector of connection interface 24 may include an electrical interface or plug interface to connect insulated cables associated with electrical conductors (e.g., conductors 11, 13, or 15 in FIGS. 1 and 2A-2C) for high-voltage drilling system 1. Additionally or alternatively, a splined quick connector of connection interface 24 may include an electrical interface or plug interface to connect insulated cables associated with electrical conductors for high-voltage drilling system 1. Additionally or alternatively, a safety valve of connection interface 24 may include an electrical interface or plug interface to connect insulated cables associated with electrical conductors for a high-voltage drilling system 1.

For connection interfaces 24A-24C, electrical conductor 11 may be extended through a coiled tubing section before the coiled tubing section and the jointed pipe section 25 are connected. In alternative embodiments, the electrical conductor 11 is extended through the coiled tubing section after the coiled tubing section and the jointed pipe section 25 are connected. For connection interface 24A, electrical conductor 11 extends from the power supply 44 to the bottomhole assemble 27 or drill bit 26. For connection interfaces 24B-24C, electrical conductor 11 extends to or near the end of the coiled tubing section.

Meanwhile, for connection interfaces 24B and 24C, electrical conductor 13 may be extended through the jointed pipe section 25 (to the bottomhole assemble 27 or drill bit 26) before the jointed pipe section 25 is connected to the extendable portion 10 of the coiled tubing section. In an alternative embodiment, the electrical conductor 13 is extended through the jointed pipe section 25 (to the bottomhole assemble 27 or drill bit 26) after the jointed pipe section 25 is connected to the extendable portion 10 of the coiled tubing section.

For connection interface 24C, electrical conductor 15 extends through at least some of connection interface 24C and facilitates connecting electrical conductors 11 and 13. The electrical conductor 15 is preinstalled with sections 31, 32, and 33 of connection interface 24C. In another embodiments, the electrical conductor 15 is installed during assemble of the hybrid drillstring 8.

The conveyance/retrieval of conductors 11, 13, 15 may be managed using pump down operations, reel-based operations, and/or other mechanisms. As needed, additional conductors and connections may be added (daisy-chained) as the length of the hybrid drill-string 8 is extended.

Figure 3A:
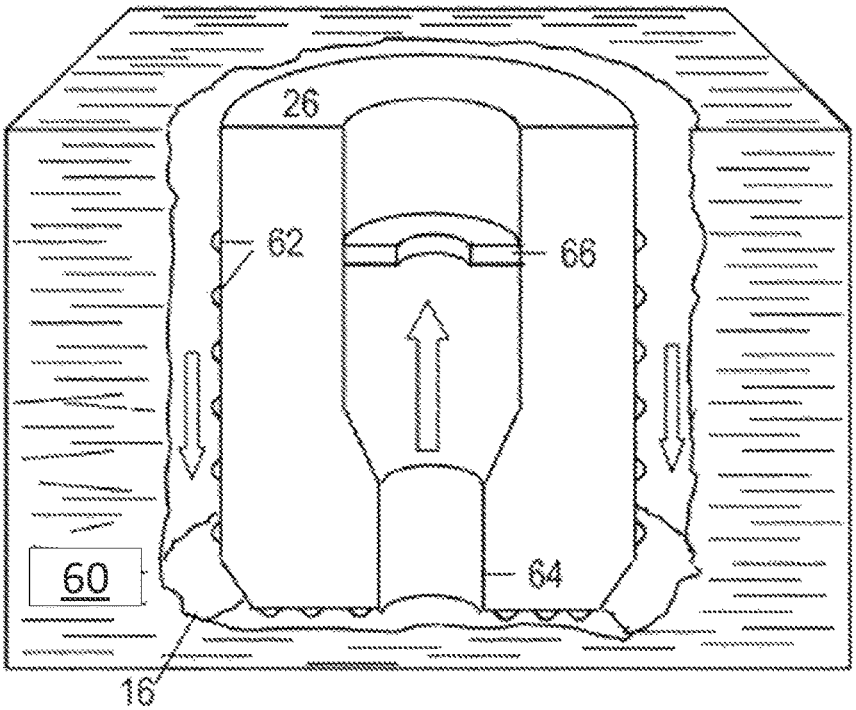
FIGS. 3A-3B show detail views of an illustrative pulsed-power drill bit with different circulation.

FIG. 3A shows a cross-sectional view of an illustrative formation 60 being penetrated by drill bit 26. Electrodes 62 on the face of the bit provide electric discharges to form the borehole 16. An optionally-cooled high-permittivity fluid drilling fluid flows down along the annular space to pass around the electrodes, enter one or more ports 64 in the bit, and return to the surface along the interior passage of the drillstring. The fluid serves to communicate the discharges to the formation and to cool the bit and clear away the debris. When the fluid has been cooled, it is subject to less bubble generation so that the discharge communication is preserved and the debris is still cleared away efficiently. Moreover, the heat generated by the electronics is drawn away by the cooled fluid, enabling the bit to continue its sustained operation without requiring periodic cool-downs.

FIG. 3A shows an optional constriction 66 that creates a pressure differential to induce gas expansion. While bubbles are undesirable near the electrodes, they may in some cases be beneficially induced or enlarged downstream of the drilling process to absorb heat and further cool the environment near the bit. The constriction may also increase pressure near the bit and inhibit bubbles in that fashion.

Figure 3B:
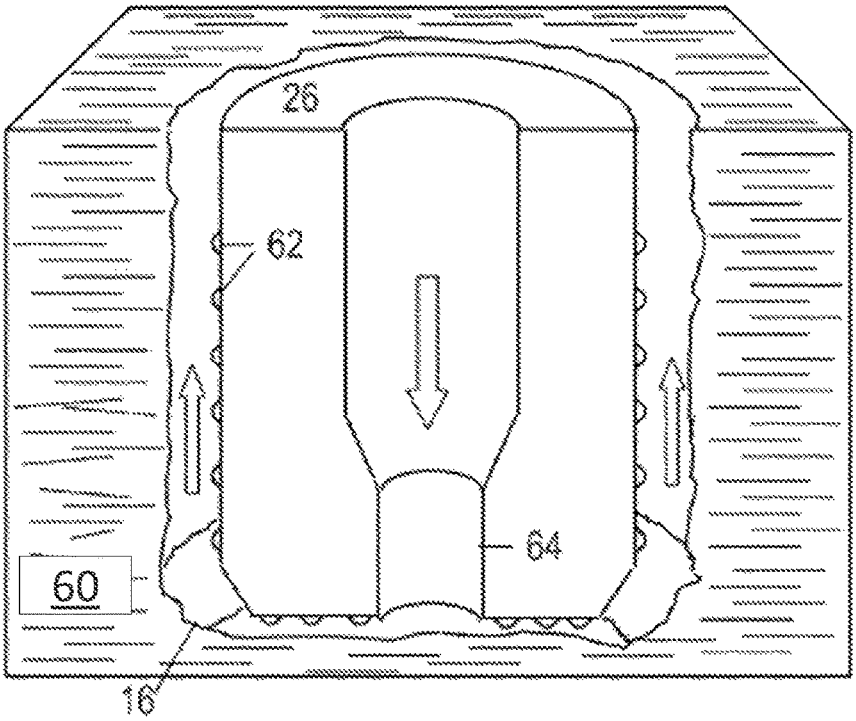

FIG. 3B shows the cross-sectional view of the bit with the opposite circulation direction. This circulation direction is typically associated with forward circulation, though as mentioned previously, a crossover sub may be employed uphole from the bit to achieve this bit flow pattern with reverse circulation in the drillstring.

FIG. 4 shows an illustrative pulsed-power drilling system employing a dual-passage drillstring 44 such as that available from Reelwell. The dual-passage drillstring 44 has an annular passage 46 around a central passage 48, enabling the drillstring to transport two fluid flows in opposite directions. In the figure, a downflow travels along annular passage 46 to the bit 26, where it exits through ports 50 to flush away debris. The flow transports the debris along the annular space 52 around the bit to ports 54, where the flow transitions to the central passage 48 and travels via that passage to the surface.

FIG. 4 further shows two rings 56 around the drillstring 44 to substantially enclose or seal the annular space 52. The ring(s) at least partially isolate the drilling fluid in the annular space 52 around the bit from the borehole fluid in the annular space 58 around the drillstring. This configuration is known to enable the use of different fluids for drilling and maintaining borehole integrity, and may further assist in maintaining the bit in contact with the bottom of the borehole when a dense borehole fluid is employed.

FIG. 5 is a flowchart of operations that may be employed in an illustrative high-voltage drilling method. While shown and discussed sequentially, the operations represented by the flowchart blocks will normally be performed in a concurrent fashion. In block 72, drill operators connect a hybrid drillstring to a bottomhole assembly having a pulsed-power or energy injection drill bit. The hybrid drillstring includes a coiled tubing section, a connection interface, and a jointed pipe section as described herein. In block 74, the drill operators lower the hybrid drillstring into a borehole. High-voltage power is conveyed to the pulsed-power or energy injection drill bit via an electrical conductor inside the hybrid drillstring at block 76. In at least some embodiments, the high-voltage power may be converted to a lower-voltage, higher-current power at or near the drill bit. At block 78, fluid is flushed to the pulsed-power or energy injection drill bit during drilling operations.

The high-voltage drilling method also may include connecting the coiled tubing section to the jointed pipe section via a connection interface that enables fluid flow continuity between the coiled tubing section and the jointed pipe section. In some embodiments, the method includes connecting the coiled tubing section to the jointed pipe section via a connection interface employing at least one of a double slip connector, a splined quick connector, and a safety valve through which an insulated cable associated with the electrical conductor extends. The double slip connector, the splined quick connector, and the safety valve enables conductivity between first and second insulated cables that form an electrical conductor extending through the hybrid drillstring (from a surface power supply to the bottomhole assembly or drill bit).

In some embodiments, the method may include extending the electrical conductor through the coiled tubing section before connecting the coiled tubing section and the jointed pipe section of the hybrid drillstring. In an alternative embodiment, the method includes extending the electrical conductor through the coiled tubing section after connecting the coiled tubing section and the jointed pipe section of the hybrid drillstring. In either case, at least part of the electrical conductor is concealed within a surface portion of the coiled tubing section. Pump down operations and/or reel-based operations may be employed to convey one or more electrical conductors through at least some of the hybrid drillstring.

Figure 6:
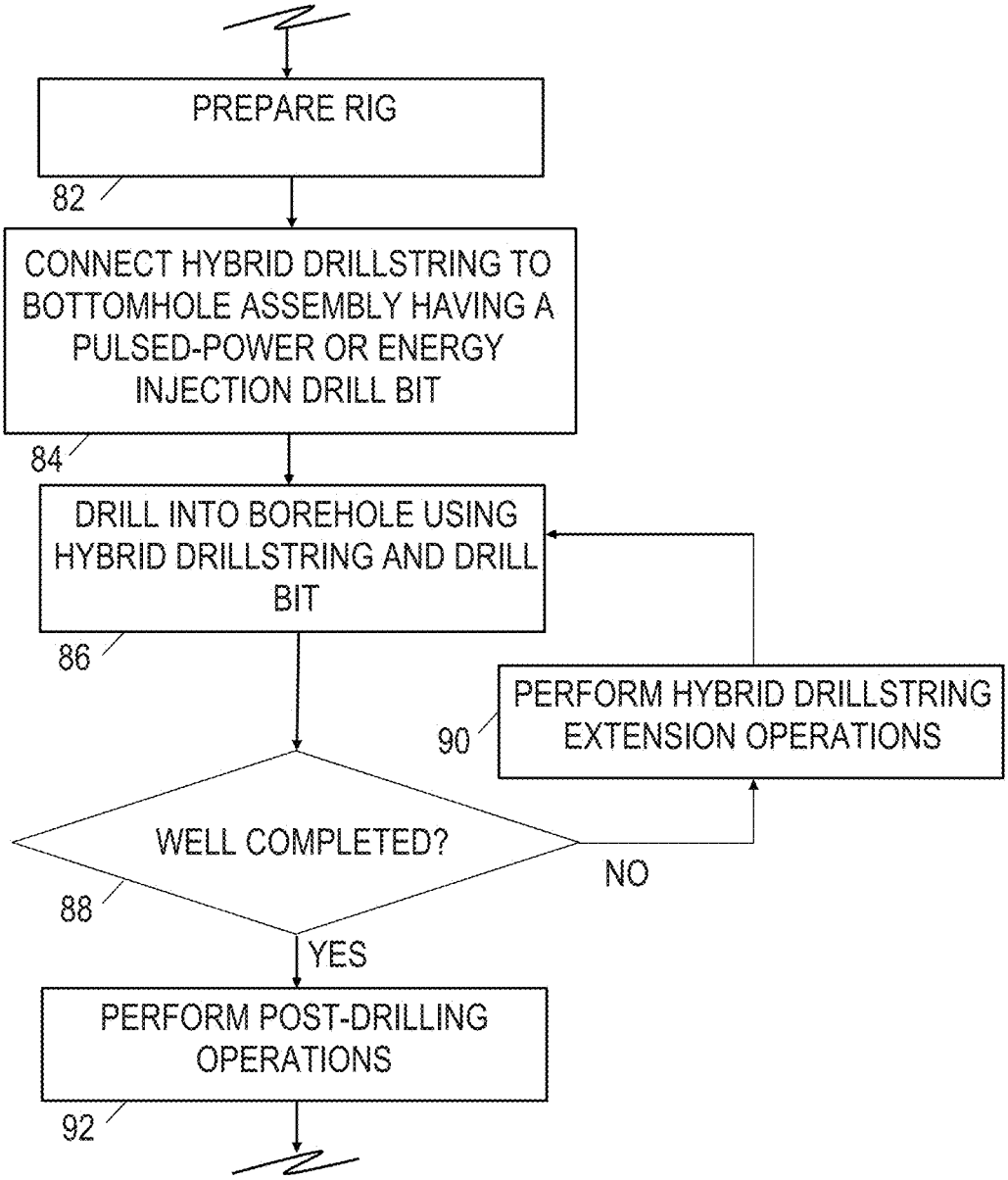
FIG. 6 is a flowchart of another illustrative high-voltage drilling method.

FIG. 6 is a flowchart of another illustrative high-voltage drilling method. In block 82, drill operators prepare a rig (e.g., drilling platform 2). At block 84, drill operators connect a hybrid drillstring to a bottomhole assembly having a pulsed-power or energy injection drill bit. At block 86, drill operators drill into a borehole using the hybrid drillstring and the drill bit. If the well is not complete (determination block 88), hybrid drillstring extension operations are performed at block 90. The hybrid drillstring extension operations include raising the hybrid drillstring and disconnecting the coiled tubing section from the jointed pipe section. The electrical conductor(s) extending through the hybrid drillstring is also disconnected or severed. The jointed pipe section is then extended by adding additional jointed pipes. For example, sufficient jointed pipes may be added such that the extended jointed pipe section fills the borehole being drilled to a point just below the rig. The electrical conductor(s) is then spliced or otherwise connected again, and the coiled tubing section is connected to the extended jointed pipe section as described herein. After the hybrid drillstring extension operations are performed at block 90, steps 86, 88, and 90 are repeated as needed until it is determined that the well is complete (determination block 88). After the well is complete, post-drilling operations are performed at block 92. Examples of pose-drilling operations include formation treatment operations, logging operations, production operations, etc. With the hybrid drillstring, the high-voltage drilling method of FIG. 6 enables faster and safer drilling compared to using jointed pipe alone.

For comparison, if a drillstring for high-voltage drilling were to be assembled using only jointed pipe, 30, 60, or 90 foot sections of jointed pipe (1, 2, or 3 pipes) could be added to extend the drillstring as needed (depending on the size of the rig). However, every time jointed pipe is added to the drill string, the electrical conductor(s) for the pulsed-power drilling will need to be disconnected, extended, and reconnected. Thus, using jointed pipe alone for high-voltage drilling becomes tedious. In contrast, use of a hybrid drillstring for high-voltage drilling enables the borehole to be extended in larger sections (e.g., 500-1000 feet at a time depending on the length of the coiled tubing). When the hybrid drillstring needs to be extended, the process of disconnecting, extending, and reconnecting the electrical conductor(s) for the high-voltage drilling is still performed, but less often (e.g., every 500-1000 feet instead of every 30, 60, or 90 feet) compared to using a drillstring with jointed pipe only. In the example given, use of a hybrid drillstring enables 500-1000 feet of jointed pipes to be added (1, 2, or 3 pipes at a time) to extend the hybrid drillstring, approximately filling the borehole, before the electrical conductor(s) for high-voltage drilling are reconnected. Thus, the disclosed techniques for high-voltage drilling using a hybrid drillstring enables faster drilling of deeper wells (e.g., 10,000 feet or more) compared jointed pipe alone. In addition, use of coiled tubing at the surface provides safety benefits for drilling operators, since the high voltage electrical conductor for high-voltage drilling can be contained within the coiled tubing.

These and other variations, modifications, and equivalents will be apparent to one of ordinary skill upon reviewing this disclosure. It is intended that the following claims be interpreted to embrace all such variations and modifications where applicable.

The invention claimed is:

1. A high-voltage drilling system, comprising:

a hybrid drillstring comprising an uphole coiled tubing section and a downhole jointed pipe section positioned within a borehole to form a first annular space between the borehole and the hybrid drillstring, each of the uphole coiled tubing section and downhole jointed pipe sections having corresponding nested tubulars forming a central passage and an annular passage, the central passage and annular passage adapted to transport two fluid flows in opposite directions along the hybrid drillstring; and a drill bit coupled proximate the downhole jointed pipe section that extends the borehole based on high-voltage power, the drill bit having one or more electrodes on an exterior thereof, one or more outlet ports for providing one of the two fluid flows to the borehole, and one or more inlet ports for receiving the other of the two fluid flows from the borehole.

2. The high-voltage drilling system of claim 1, wherein the drill bit includes an internal passage for transferring the other of the two fluid flows received from the one or more inlet ports to the hybrid drillstring.

3. The high-voltage drilling system of claim 2, further including a constriction positioned within the internal passage and configured to increase a pressure proximate an exterior of the drill bit.

4. The high-voltage drilling system of claim 3, wherein the constriction reduces an area of flow within the internal passage by at least 50 percent.

5. The high-voltage drilling system of claim 1, wherein the annular passage is configured to transfer drilling fluid to the borehole from uphole, and the central passage is configured to transfer detached formation material from the borehole uphole.

6. The high-voltage drilling system of claim 5, wherein the drill bit further includes one or more rings that substantially seal a second annular space between a lower end of the drill bit and the borehole and thereby force the detached formation material through the one or more inlet ports into the first internal passage up through the central passage of the hybrid drillstring and out of the borehole.

7. The high-voltage drilling system of claim 1, wherein the drill bit is coupled to at a lower end of the downhole jointed pipe section.

8. The high-voltage drilling system of claim 1, further including a bottomhole assembly with the drill bit coupled to a lower end of the downhole jointed pipe section, wherein the drill bit performs pulsed-power drilling operations based on the high-voltage power and wherein the bottomhole assembly does not include a drill collar.

9. The high-voltage drilling system of claim 1, further including a power supply to output high-voltage power, and an electrical conductor coupling the power supply to the one or more electrodes, and further wherein all of the electrical conductor resides within the hybrid drillstring.

10. A method for high-voltage drilling, comprising:

lowering a drill bit into a borehole, the drill bit having one or more electrodes on an exterior thereof, one or more outlet ports for transporting a first fluid to the borehole, and one or more inlet ports for receiving a second fluid from the borehole, the drill bit coupled to a hybrid drillstring comprising an uphole coiled tubing section and a downhole jointed pipe section positioned within the borehole to form a first annular space between the borehole and the hybrid drillstring, each of the uphole coiled tubing section and downhole jointed pipe sections having corresponding nested tubulars forming a central passage and an annular passage, the central passage and annular passage adapted to transport the first and second fluids in opposite directions along the hybrid drillstring;

conveying high-voltage power to the one or more electrodes of the drill bit via an electrical conductor to extend the borehole, while the first fluid is pumped downhole using one of the central passage or the annular passage; and transporting the second fluid received from the one or more inlet ports in the drill bit out of the borehole using the other of the central passage or the annular passage.

11. The method of claim 10, further including connecting the hybrid drillstring to a bottomhole assembly having the drill bit prior to lowering the drillstring into the borehole.

12. The method of claim 10, wherein the drill bit includes an internal passage for transferring the second fluid received from the one or more inlet ports to the hybrid drillstring.

13. The method of claim 12, wherein the drill bit further includes a constriction positioned within the internal passage, the constriction increasing a pressure proximate an exterior of the drill bit.

14. The method of claim 10, wherein the first fluid includes drilling fluid, and the second fluid includes detached formation material.

15. The method of claim 14, wherein the annular passage is configured to transfer the drilling fluid to the borehole from uphole, and the central passage is configured to transfer the detached formation material uphole from the borehole.

16. The method of claim 15, wherein the drill bit further includes one or more rings that substantially seal a second annular space between a lower end of the drill bit and the borehole, and further including forcing the detached formation material through the one or more inlet ports into the first internal passage up through the central passage of the hybrid drillstring and out of the borehole using the one or more rings.

17. The method of claim 10, wherein conveying high-voltage power to the one or more electrodes includes performing pulsed-power drilling based on the high-voltage power without the drill bit rotating.

* * * * *